US008135323B2

(12) United States Patent
Suzuki et al.

(10) Patent No.: US 8,135,323 B2
(45) Date of Patent: Mar. 13, 2012

(54) CONVEYING DEVICE, FIXING DEVICE AND IMAGE FORMING APPARATUS

(75) Inventors: Yasuo Suzuki, Saitama (JP); Yukihiro Ichiki, Kanagawa (JP); Motoyuki Yagi, Kanagawa (JP); Satoshi Isahai, Saitama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 6 days.

(21) Appl. No.: 12/870,511

(22) Filed: Aug. 27, 2010

(65) Prior Publication Data

US 2011/0236086 A1 Sep. 29, 2011

(30) Foreign Application Priority Data

Mar. 25, 2010 (JP) ..... 2010-070334

(51) Int. Cl.
*G03G 15/20* (2006.01)

(52) U.S. Cl. ..... 399/329

(58) Field of Classification Search ..... 399/329, 399/33, 67, 122, 320, 307, 322, 327, 400, 399/165, 312, 313; 347/156
See application file for complete search history.

(56) References Cited

U.S. PATENT DOCUMENTS

| | | | | |
|---|---|---|---|---|
| 6,060,205 | A | 5/2000 | Takeichi et al. | |
| 2007/0223978 | A1* | 9/2007 | Ishii et al. | 399/329 |
| 2008/0310866 | A1* | 12/2008 | Kim | 399/33 |
| 2009/0162115 | A1* | 6/2009 | Kobayashi | 399/329 |
| 2010/0290822 | A1* | 11/2010 | Hasegawa et al. | 399/329 |
| 2010/0303526 | A1* | 12/2010 | Hayase | 399/329 |

FOREIGN PATENT DOCUMENTS

| | | | |
|---|---|---|---|
| JP | 9-114341 | A | 5/1997 |
| JP | 11-338307 | A | 12/1999 |
| JP | 2000-181284 | A | 6/2000 |
| JP | 2000-206722 | A | 7/2000 |
| JP | 2006-058527 | A | 3/2006 |
| JP | 2007-333788 | A | 12/2007 |

* cited by examiner

*Primary Examiner* — David Porta
*Assistant Examiner* — Kiho Kim
(74) *Attorney, Agent, or Firm* — Sughrue Mion, PLLC

(57) ABSTRACT

A conveying device includes: a rotating body that rotates; a belt that contacts the rotating body and rotates; a restricting member that is disposed at each of the two rotation axis direction side edges of the belt, positions the side edges of the belt, and restricts movement of the belt in the rotation axis direction; a lubrication agent that is supplied to the inner peripheral face of the belt; and a slide bearing that is disposed so as to overlap in the rotation axis direction with the restricting member when viewed along a rotating body radial direction, the slide bearing being open to the belt side and rotatably supporting the rotating body.

14 Claims, 12 Drawing Sheets

CONVEYING DEVICE, FIXING DEVICE AND IMAGE FORMING APPARATUS

CROSS-REFERENCE TO RELATED APPLICATION

This application is based on and claims priority under 35 USC 119 from Japanese Patent Application No. 2010-070334 filed on Mar. 25, 2010.

BACKGROUND

Technical Field

The present invention relates to a conveying device, a fixing device, and an image forming apparatus.

SUMMARY

A first aspect of the present invention is a conveying device including: a rotating body that rotates; a belt that contacts the rotating body and rotates; a restricting member that is disposed at each of the two rotation axis direction side edges of the belt, positions the side edges of the belt, and restricts movement of the belt in the rotation axis direction; a lubrication agent that is supplied to the inner peripheral face of the belt; and a slide bearing that is disposed so as to overlap in the rotation axis direction with the restricting member when viewed along a rotating body radial direction, the slide bearing being open to the belt side and rotatably supporting the rotating body.

BRIEF DESCRIPTION OF THE DRAWINGS

Exemplary embodiments of the present invention will be described in detail based on the following figures, wherein.

DETAILED DESCRIPTION

Explanation follows of an exemplary embodiment according to the present invention, based on the figures.

Figure 1:
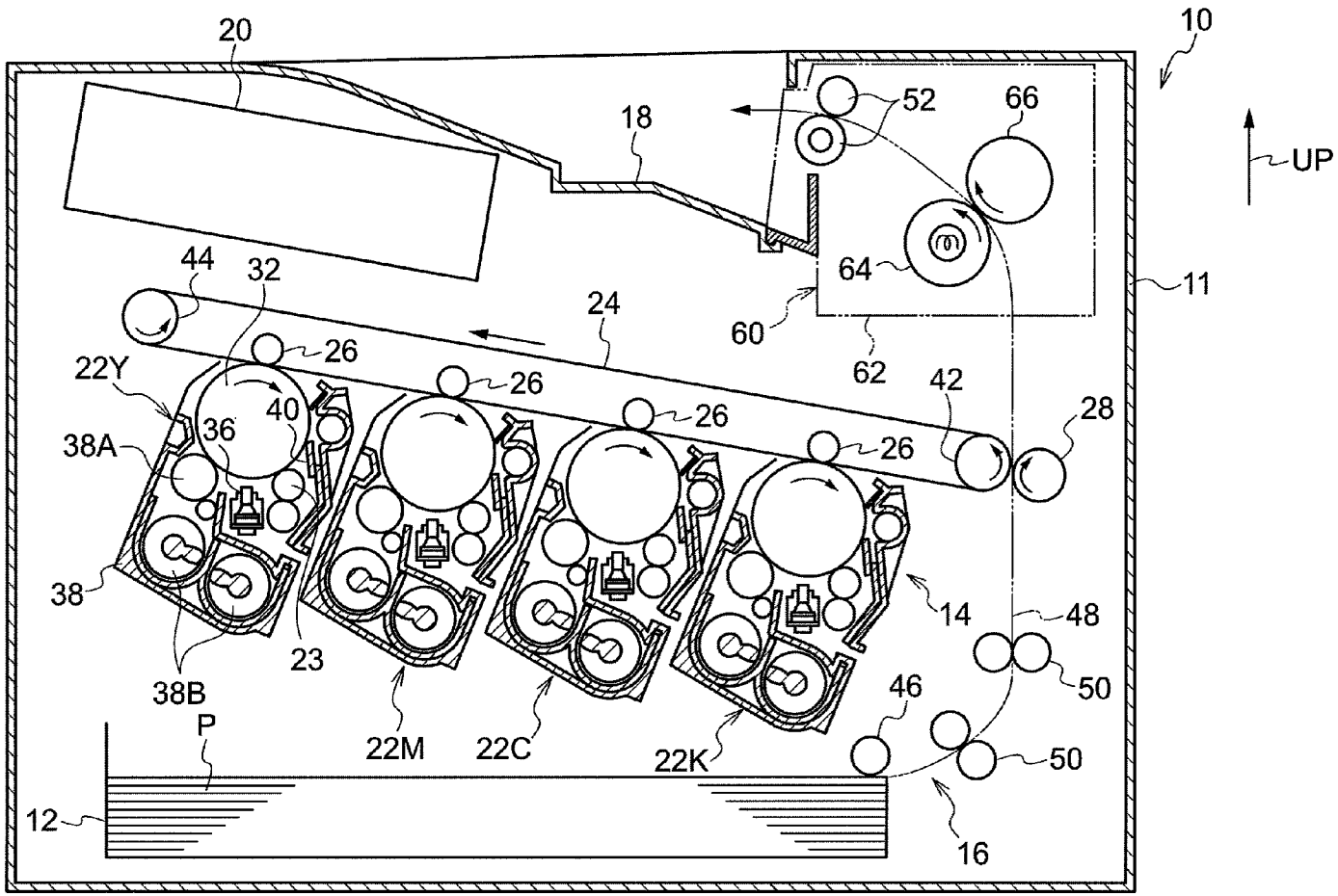
FIG. 1 is a schematic diagram showing a configuration of an image forming apparatus according to the present exemplary embodiment.

Configuration of an Image Forming Apparatus According to the Present Exemplary Embodiment First, explanation follows of a configuration of an image forming apparatus according to the present exemplary embodiment. FIG. 1 is a schematic diagram showing a configuration of an image forming apparatus according to the present exemplary embodiment. In the drawing the direction of arrow UP indicates the upwards vertical direction.

An image forming apparatus 10, as shown in FIG. 1, is equipped with an image forming apparatus body 11 in which various configuration components are internally housed. Inside the image forming apparatus body 11 are provided: a housing section 12 in which a recording medium P, such as, for example, paper, is housed; an image forming section 14 that forms an image on the recording medium P; a conveying section 16 that conveys the recording medium P from the housing section 12 to the image forming section 14; and a controller 20 that controls the operation of each section of the image forming apparatus 10. A discharge section 18 is provided at an upper portion of the image forming apparatus body 11, into which is discharged the recording medium P formed with an image by the image forming section 14.

The image forming section 14 includes: image forming units 22Y, 22M, 22C, 22K (referred to below as 22Y to 22K) that form toner images of each of the colors yellow (Y), magenta (M), cyan (C) and black (K), respectively; an intermediate transfer belt 24 onto which the toner images formed at the image forming units 22Y to 22K are transferred; primary transfer rolls 26 that transfer onto the intermediate transfer belt 24 the toner images that have been formed on the image forming units 22Y to 22K; and a secondary transfer roll 28 that transfers the toner images transferred onto the intermediate transfer belt 24 by the primary transfer rolls 26, from the intermediate transfer belt 24 onto the recording medium P. The image forming section 14 is not limited to the configuration described above, and any other configuration that forms an image on the recording medium P may be adopted.

The image forming units 22Y to 22K are disposed in a row at a top-bottom direction central portion of the image forming apparatus 10, the row being at an angle inclined to the horizontal direction. Each of the image forming units 22Y to 22K has a respective photoreceptor 32 that rotates in one direction (for example, the clockwise direction in FIG. 1). Since the image forming units 22Y to 22K are each of a similar configuration to each other, reference numbers for each of the components of the image forming units 22M, 22C and 22K are omitted in FIG. 1.

Around the periphery of each of the photoreceptors 32 are provided, in sequence from the photoreceptor 32 rotation direction upstream side: a charging roll 23, serving as an example of a charging device, that charges the photoreceptor 32; an exposing device 36 that light-exposes the photoreceptor 32 that has been charged by the charging roll 23, thereby forming an electrostatic latent image on the photoreceptor 32; a developing device 38 that develops the electrostatic latent image formed on the photoreceptor 32 by the exposing device 36 and forms a toner image; and a cleaning member 40 that contacts the photoreceptor 32 and cleans off any toner remaining on the photoreceptor 32.

The exposing device 36 forms an electrostatic latent image based on an image signal transmitted from the controller 20. As an image signal transmitted from the controller 20 there is, for example, an image signal the controller 20 has acquired from an external device.

The developing device 38 includes a developer supply body 38A that supplies a developer onto the photoreceptor 32, and plural conveying members 38B that convey, while stirring, the developer for application onto the developer supply body 38A.

The intermediate transfer belt 24 is formed in a loop shape disposed above the image forming units 22Y to 22K. Entraining rolls 42, 44 are provided at the inner peripheral side of the intermediate transfer belt 24, with the intermediate transfer belt 24 entrained around the entraining rolls 42, 44. The intermediate transfer belt 24 is configured so as to perform circulatory movement (rotation) in one direction (for example, the anticlockwise direction in FIG. 1) while making contact with the photoreceptors 32, due to one or other of the entraining rolls 42, 44 being rotationally driven. The entraining roll 42 is a facing roll that faces the secondary transfer roll 28.

Each of the primary transfer rolls 26 faces the respective photoreceptor 32, with the intermediate transfer belt 24 nipped therebetween. Primary transfer positions are formed between the primary transfer rolls 26 and the photoreceptors 32, with the toner image formed on each of the photoreceptors 32 transferred onto the intermediate transfer belt 24 at these primary transfer positions.

The secondary transfer roll 28 faces the entraining roll 42, with the intermediate transfer belt 24 nipped therebetween. A secondary transfer position is formed between the secondary transfer roll 28 and the entraining roll 42, with the toner images formed on the intermediate transfer belt 24 transferred onto the recording medium P at this secondary transfer position.

The conveying section 16 includes: a feed roll 46 that feeds out recording medium P housed in the housing section 12; a conveying path 48 along which is conveyed the recording medium P that has been fed out by the feed roll 46; plural conveying rolls 50 disposed along the conveying path 48 and conveying the recording medium P fed out by the feed roll 46 to the secondary transfer position.

A fixing device 60, serving as an example of a conveying device for conveying the recording medium P (serving as an example of a conveyed member), is provided further to the conveying direction downstream side than the secondary transfer position, the fixing device 60 fixing onto the recording medium P the toner images that were transferred onto the recording medium P by the secondary transfer roll 28. Discharge rolls 52 are provided to the fixing device 60 for discharging the recording medium P fixed with the toner images into the discharge section 18. A specific configuration of the fixing device 60 is described below.

Next, explanation follows regarding an image forming operation, for forming an image on the recording medium P, in the image forming apparatus 10 according to the present exemplary embodiment.

In the image forming apparatus 10 according to the present exemplary embodiment, the recording medium P fed out from the housing section 12 by the feed roll 46 is fed into the secondary transfer position by the plural conveying rolls 50.

In the image forming units 22Y to 22K, the photoreceptors 32 that have been charged by the charging rolls 23 are exposed by the exposing devices 36, whereby electrostatic latent images are formed on the photoreceptors 32. Toner images are formed on the photoreceptor 32 by development of the electrostatic latent images with the developing devices 38. The toner images of each of the respective colors formed on the image forming units 22Y to 22K are superimposed onto the intermediate transfer belt 24 at the primary transfer positions, thereby forming a full color image. The full color image formed on the intermediate transfer belt 24 is then transferred onto the recording medium P at the secondary transfer position.

The recording medium P onto which the toner image has been transferred is conveyed to the fixing device 60, and the transferred toner image is fixed by the fixing device 60. The recording medium P to which the toner image is fixed is discharged into the discharge section 18 by the discharge rolls 52. A cycle of image forming operation is performed as described above.

Figure 2:
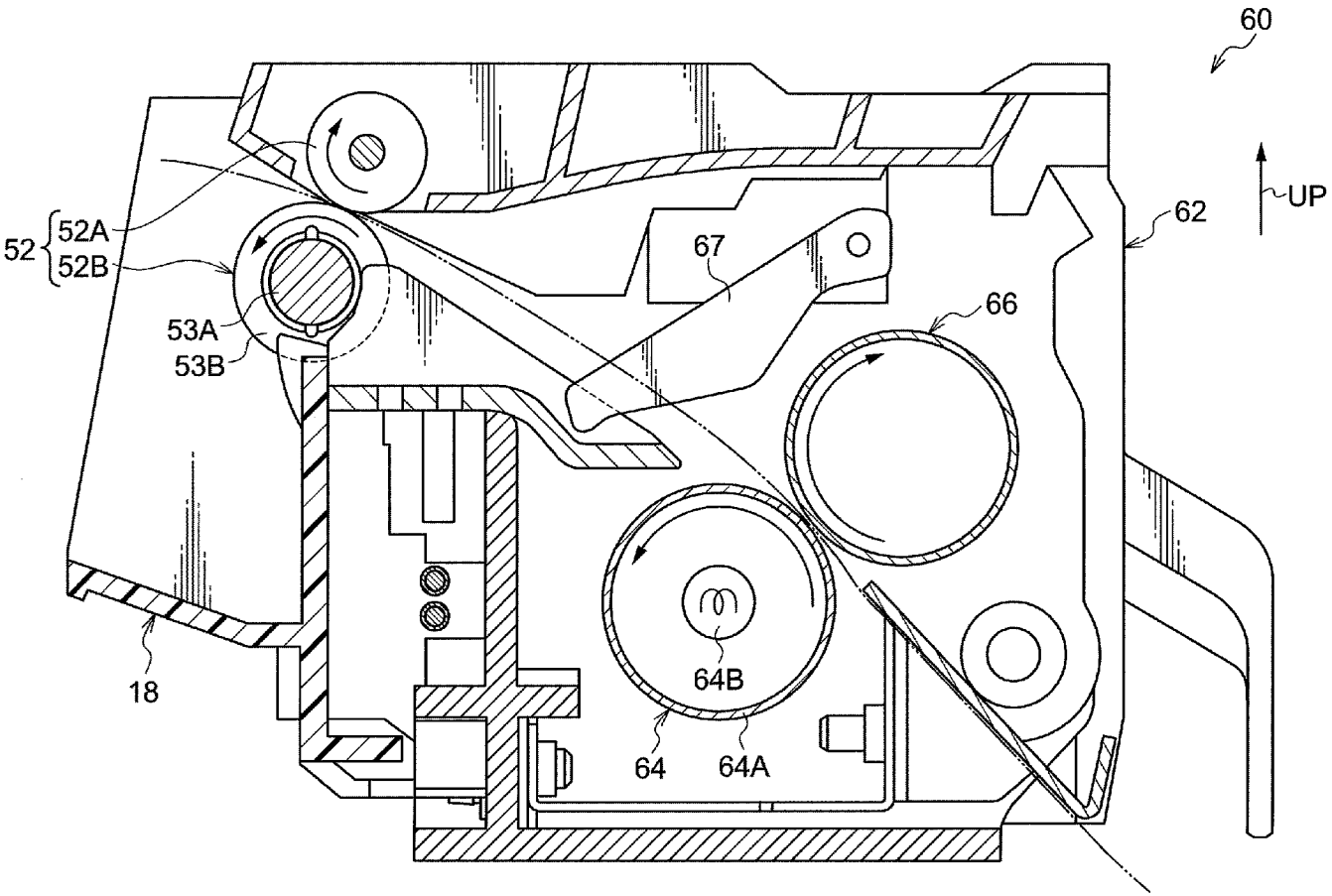
FIG. 2 is a cross-section showing a configuration of a fixing device according to the present exemplary embodiment.

Configuration of the Fixing Device 60 According to the Present Exemplary Embodiment Next, explanation follows of a configuration of the fixing device 60 according to the present exemplary embodiment. FIG. 2 is a schematic diagram showing a configuration of the fixing device 60 according to the present exemplary embodiment. The arrow UP in the drawing indicates the upwards vertical direction.

The fixing device 60 according to the present exemplary embodiment is, as shown in FIG. 2, equipped with a fixing device body 62 that is detachably mounted to the image forming apparatus body 11, with each of the configuration components of the fixing device 60 provided in the fixing device body 62. The fixing device body 62 is provided with a rotating heating roll 64, serving as an example of a rotating body, and a rotating pressure belt 66 that contacts the heating roll 64 and serves as an example of a belt. Specifically, in the present exemplary embodiment, the pressure belt 66 functions as a ring shaped conveying belt that rotates while nipping the recording medium P (an example of a conveyed member) between itself and the heating roll 64, thereby conveying the recording medium P.

On the conveyed recording medium P, nipped by the heating roll 64 and the pressure belt 66, the toner on the recording medium P is subjected to heating by the heating roll 64, and the toner on the recording medium P is subjected to application of pressure by the pressure belt 66, such that the image is fixed in the contact region of the heating roll 64 and the pressure belt 66. A specific configuration of the heating roll 64 and the pressure belt 66, and the support structure of the heating roll 64 and the pressure belt 66 are described below.

In the fixing device body 62, the pair of discharge rolls 52 is provided for discharging from the fixing device body 62 the recording medium P, to which the toner image has been fixed by the heating roll 64 and the pressure belt 66, into the discharge section 18. The pair of discharge rolls 52 is configured with a following roll 52A and a drive roll 52B disposed at the lower side of the following roll 52A. The drive roll 52B is configured with a drive shaft 53A and a roll section 53B provided to the drive shaft 53A. A portion of the discharge section 18 is formed in the fixing device body 62.

In FIG. 2, the conveying path along which the recording medium P is conveyed, by the pair of discharge rolls 52 and the heating roll 64 and the pressure belt 66, is shown by a double-dotted dashed line. A detection flipper 67, serving as an example of a detection portion for detecting the recording medium P, is provided on the conveying path, between the heating roll 64-pressure belt 66 and the pair of discharge rolls 52.

Explanation follows regarding a specific configuration of the heating roll 64 and the pressure belt 66, and a support structure of the heating roll 64 and the pressure belt 66.

The heating roll 64 is configured including a cylindrical shaped circular cylinder member 64A, and a heating source 64B, such as, for example, a halogen lamp, provided within the hollow space within the circular cylinder member 64A.

Figure 3:
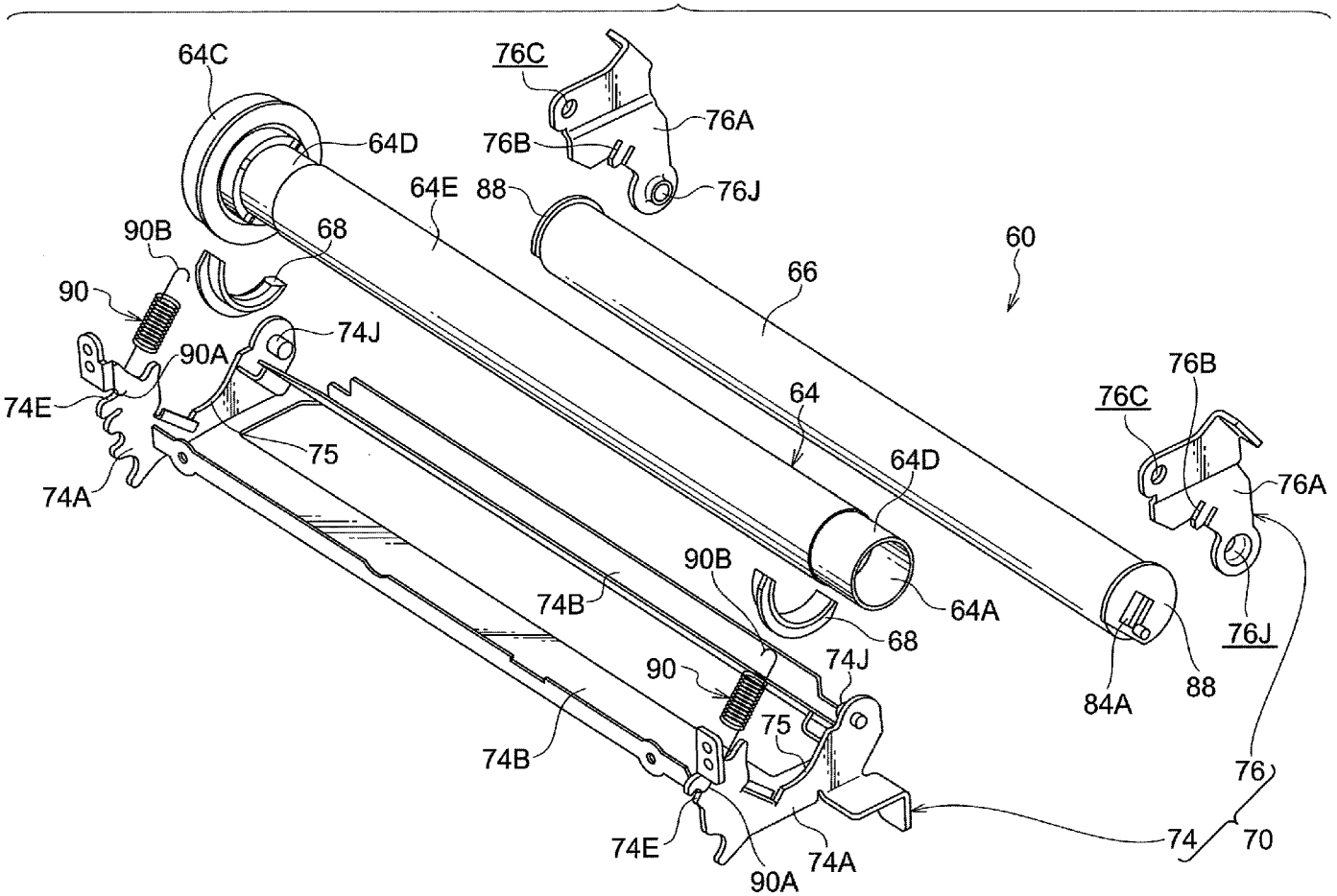
FIG. 3 is an exploded perspective view showing a heating roll and a pressure belt, and a support structure thereof, according to the present exemplary embodiment.
Figure 4:
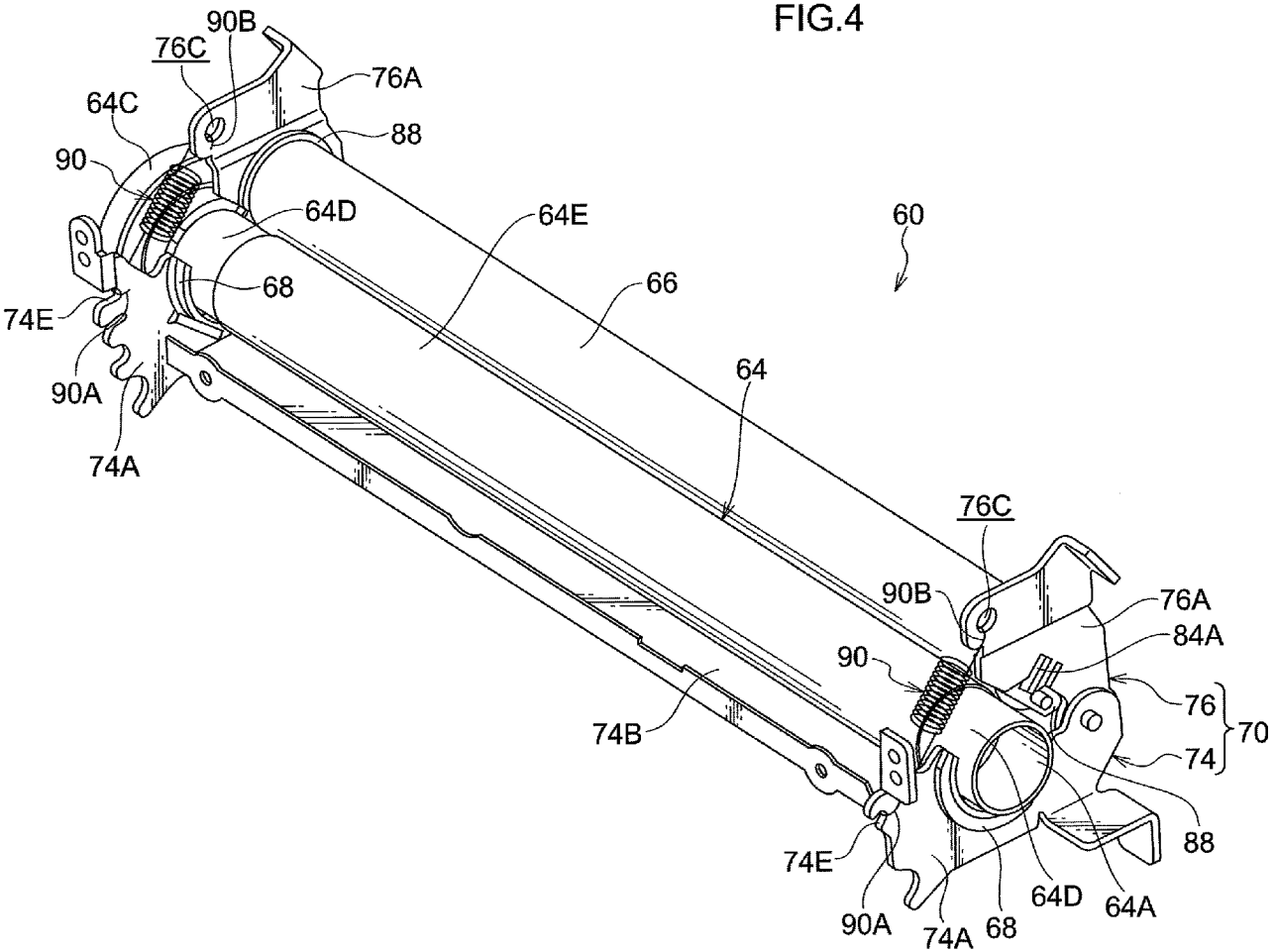
FIG. 4 is a perspective view showing a heating roll and a pressure belt, and a support structure thereof, according to the present exemplary embodiment.

The circular cylinder member 64A is formed from a metal material, such as, for example, aluminum, stainless steel or the like. A gear 64C is attached at one axial direction end portion of the circular cylinder member 64A, as shown in FIG. 3 and FIG. 4, for transmitting rotation force from a drive motor to the circular cylinder member 64A.

The two axial direction end portions of the circular cylinder member 64A configure supported portions 64D that are supported on slide bearings 68, described below. At one axial direction end of the circular cylinder member 64A, at the side where the gear 64C is disposed, the supported portion 64D is disposed further to the axial direction center than the position at which the gear 64C is attached.

A cover member 64E is provided so as to cover the outer peripheral surface of the circular cylinder member 64A between the supported portions 64D at the two axial direction ends of the circular cylinder member 64A. The cover member 64E is formed from a resilient material, such as, for example, rubber.

A support body 70 is provided in the fixing device body 62 for supporting the heating roll 64 and the pressure belt 66. The support body 70 is configured including a roll support member 74 for supporting the heating roll 64, and a belt support member 76 for supporting the pressure belt 66.

The roll support member 74 is configured including a pair of side plates 74A (serving as an example of a pair of support members) disposed at the two axial direction ends of the heating roll 64, respectively, and supporting a pressing member 80, described below, and a coupling plate 74B that is disposed between the pair of side plates 74A and couples the pair of side plates 74A together.

A recess 75 is formed in each of pair of side plates 74A, cutout in a circular arc shape. The slide bearings 68 that are formed in a circular arc shape to follow the recesses 75 are each attached to the pair of side plates 74A, respectively. The slide bearings 68 rotatably support the supported portions 64D of the circular cylinder member 64A.

Shaft portions 74J, serving as examples of support portions, are provided at one end portion of each of the pair of side plates 74A (the right hand end portion in FIG. 3 and FIG. 4) for rotatably supporting the belt support member 76.

Attachment portions 74E are provided at portions at the other end (the left hand end portion in FIG. 3 and FIG. 4) of each of the pair of respective side plates 74A. One end of respective tension springs 90, serving as examples of resilient members, is attached to the attachment portions 74E. Specifically, the attachment portions 74E are configured as recesses formed in the pair of side plates 74A. One of the ends of each of the tension springs 90 is formed into a hook 90A so as to hook onto respective attachment portion 74E configured as a recess portion. The recess portion configuring the attachment portions 74E may be configured as a through hole.

The belt support member 76 is configured with a pair of side plates 76A disposed at both axial direction edges of the pressure belt 66. Supported holes 76J, serving as examples of supported portions supported by the shaft portions 74J of the pair of side plates 74A of the roll support member 74, are formed in portions at one end (end portions at the right hand bottom side in FIG. 3) of the pair of side plates 76A, respectively. The pair of side plates 76A are respectively supported, rotatable about the axis of the shaft portions 74J relative to the pair of side plates 74A of the roll support member 74, by the shaft portions 74J fitting into the supported holes 76J.

Attachment portions 76C are respectively provided at portions at the other end of the pair of side plates 76A (end portions the left hand top side in FIG. 3), and the portions at the other ends of the respective tension springs 90 are attached to the attachment portions 76C. The attachment portions 76C are, specifically, configured as through holes passing through the pair of side plates 76A. Configuration is made such that hooks 90B formed in the other end portions of the tension springs 90 are hooked into the attachment portions 76C configured as through holes. The through holes configuring the attachment portions 76C may be configured by recesses.

Projection portions 84A of a plate body 84, described below, are respectively insertable from the left hand bottom side in FIG. 3 into insertion grooves 76B formed in the pair of side plates 76A.

Figure 5:
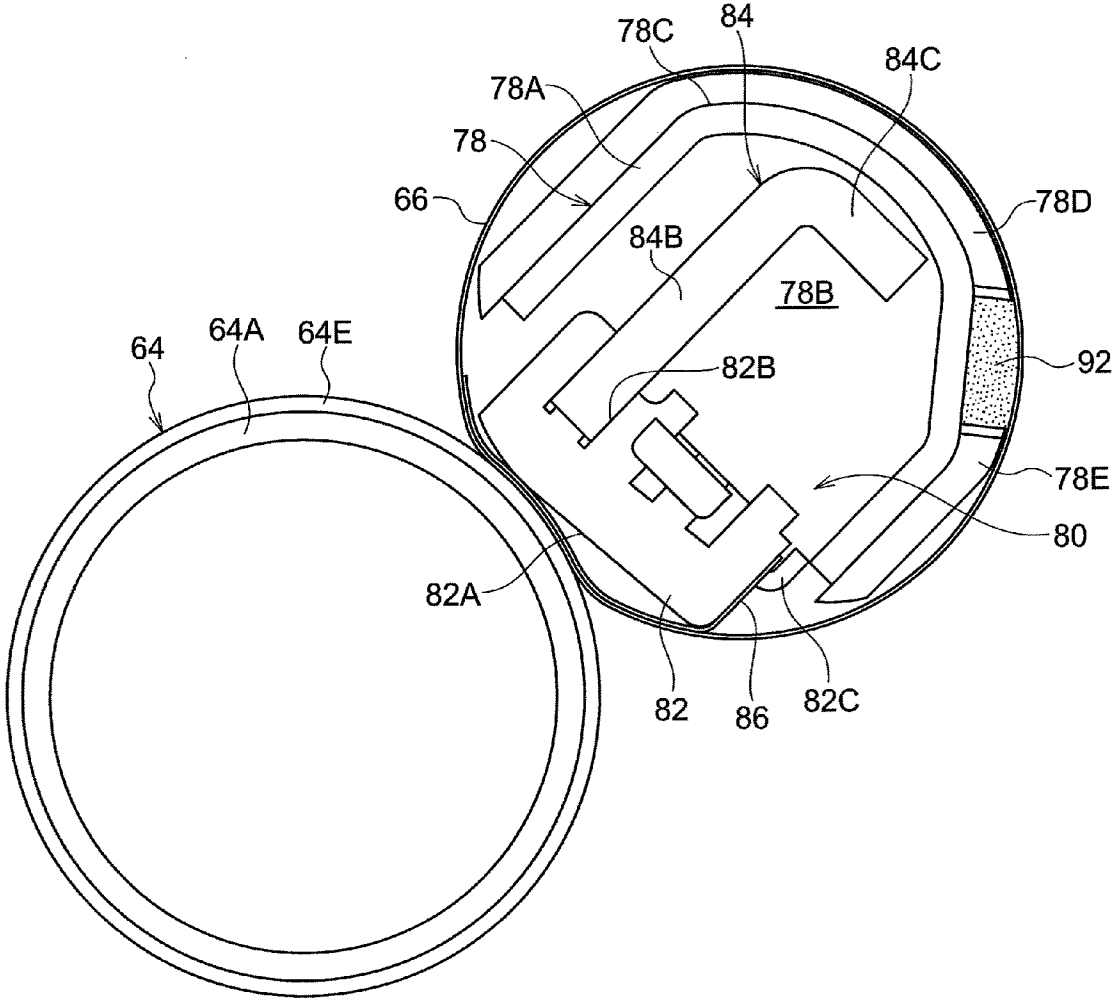
FIG. 5 is a lateral cross-section of a heating roll and a pressure belt according to the present exemplary embodiment.

As shown in FIG. 5, a pressing member 80 for pressing the pressure belt 66 towards the heating roll 64 is disposed at the inner periphery side of the pressure belt 66, along the rotation axis direction of the pressure belt 66.

The pressing member 80 includes a pressing body 82 disposed at the heating roll 64 side, the plate body 84 provided to the pressing body 82 and L-shaped in side view, and a membrane body 86 attached to the pressing body 82.

Figure 6:
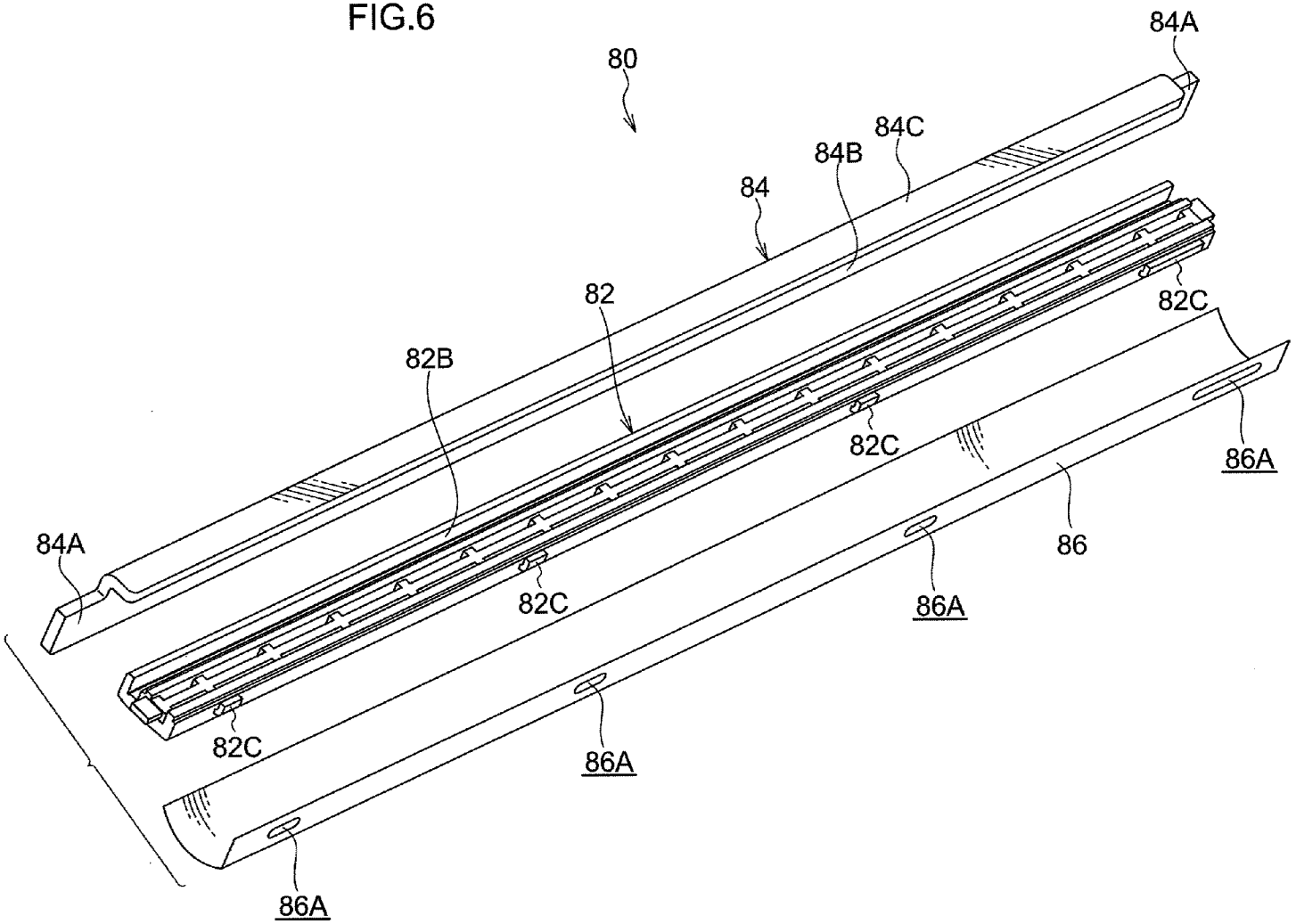
FIG. 6 is an exploded perspective view of a pressing member according to the present exemplary embodiment.
Figure 7:
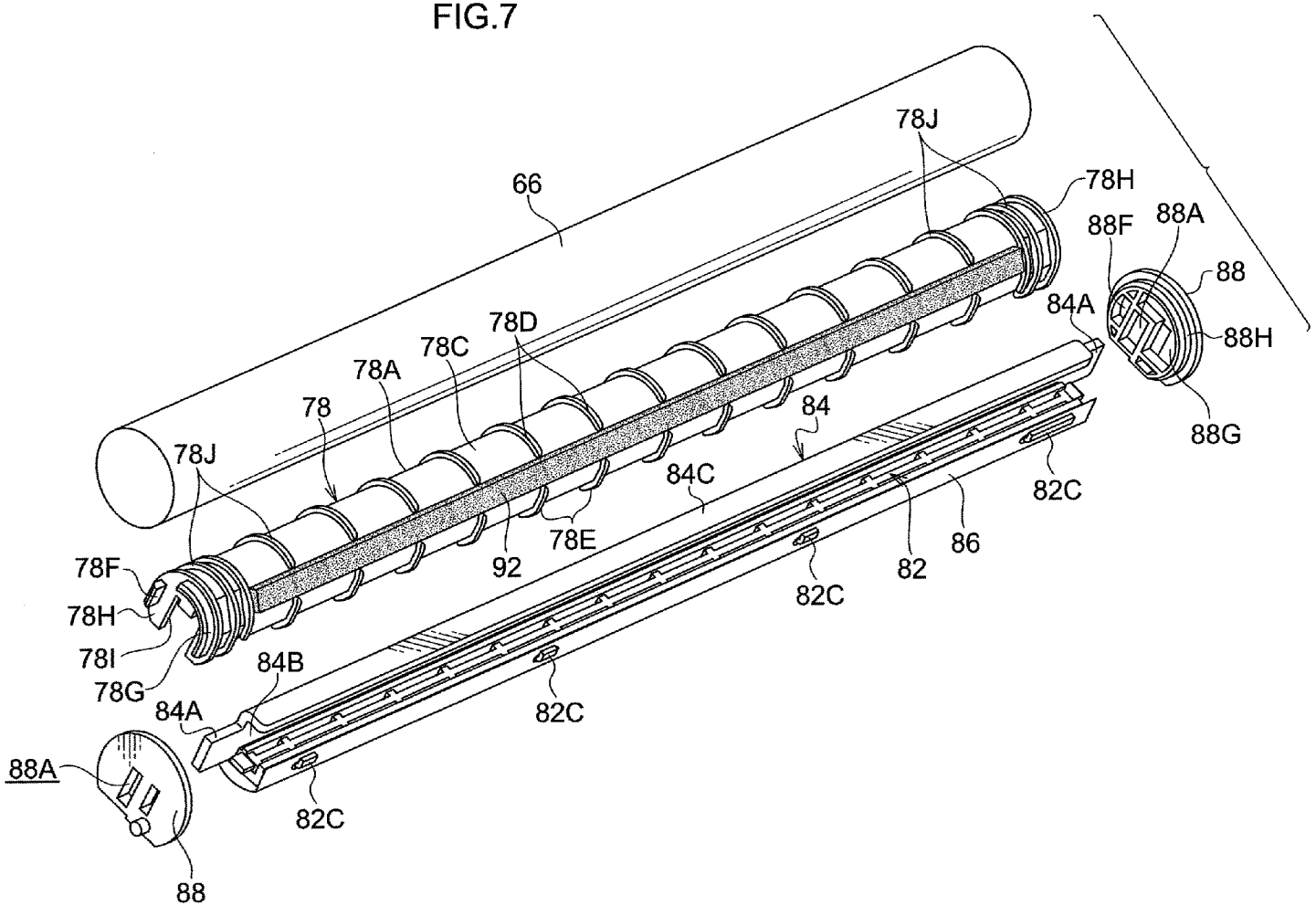
FIG. 7 is a perspective view showing a configuration of a pressure belt, a contact member, a restricting member and a pressing member according to the present exemplary embodiment.

The pressing body 82, as shown in FIG. 6 and FIG. 7, has its length running along the rotation axis direction of the pressure belt 66, and is also formed in a substantially rectangular shape (block shape) in side view, as shown in FIG. 5. An opposing face 82A is formed at the heating roll 64 side (the left hand bottom side in FIG. 5) of the pressing body 82, facing the heating roll 64 with the pressure belt 66 and the membrane body 86 therebetween. The opposing face 82A functions as a pressing face for pressing towards the heating roll 64.

An insertion groove 82B is formed along the length direction of the pressing body 82 at the side (the right hand top side in FIG. 5) of the pressing body 82 distanced from the heating roll 64 (see FIG. 6). The insertion groove 82B is inserted into by the plate body 84. As shown in FIG. 5, the insertion groove 82B is disposed at the pressure belt 66 rotation direction downstream side (the left hand top side in FIG. 5) of the pressing body 82. Since the pressing body 82 is imparted with pressing force from the plate body 84 inserted into the insertion groove 82B, the pressing force of the opposing face 82A against the heating roll 64 is greatest at the portion where the insertion groove 82B is disposed.

Hooks 82C are provided at the pressure belt 66 rotation direction upstream side (the right hand bottom side in FIG. 5) of the pressing body 82, the hooks 82C serving as examples of attaching portions to which the membrane body 86 is attached. Plural of the hooks 82C are provided at the side face of the pressing body 82 (see FIG. 6) along the length direction of the pressing body 82.

The plate body 84, as shown in FIG. 7, has its length direction running along the pressure belt 66 rotation axis direction. As shown in FIG. 5, the plate body 84 is, in side view, configured including a plate portion 84B extending from the right hand top side towards the left hand bottom side in FIG. 5, and a plate portion 84C extending from the side of the plate portion 84B distanced from the pressing body 82 (the right hand top side of FIG. 5) to the right hand bottom side in FIG. 5. The leading end of the plate portion 84B at the heating roll 64 side is configured so as to be inserted into the insertion groove 82B of the pressing body 82.

As shown in FIG. 6, the projecting portions 84A are formed at both length direction ends of the plate portion 84B, projecting further in the length direction to the outside than the plate portion 84C.

The membrane body 86, as shown in FIG. 7, has its length direction running along the pressure belt 66 rotation axis direction. The membrane body 86 is formed with attachment holes 86A, serving as examples of attached portions, to which the hooks 82C of the pressing body 82 are attached. The attachment holes 86A of the membrane body 86 are attached to by the hooks 82C of the pressing body 82 and the membrane body 86 is disposed between the opposing face 82A of the pressing body 82 and the inner peripheral face of the pressure belt 66.

As shown in FIG. 5, a contact member 78 that makes sliding contact with the rotating pressure belt 66 is disposed along the pressure belt 66 rotation axis direction at the inner periphery side of the pressure belt 66. As shown in FIG. 7, the contact member 78 has a length direction running along the rotation axis direction of the pressure belt 66, and also, as shown in FIG. 5, has a peripheral wall 78A formed along a portion of the circumferential direction of the pressure belt 66. Specifically, the contact member 78 is formed running along the circumferential direction of the pressure belt 66 excluding a portion at the heating roll 64 side (the left hand bottom side in FIG. 5). The contact member 78 is thereby open at the heating roll 64 side (the left hand bottom side in FIG. 5), and a housing space 78B is formed at the inner peripheral side of the peripheral wall 78A, capable of housing the pressing member 80.

As shown in FIG. 7, first ribs 78D, serving as examples of first protrusion portions, are formed on the outer peripheral face 78C of the peripheral wall 78A along the circumferential direction of the peripheral wall 78A (the pressure belt 66 rotation direction). Plural of the first ribs 78D are disposed at intervals along the length direction of the peripheral wall 78A.

Second ribs 78E, serving as examples of second protrusion portions, are formed on the outer peripheral face 78C of the peripheral wall 78A, along the circumferential direction of the peripheral wall 78A (the pressure belt 66 rotation direction) so as to be spaced apart from the first ribs 78D in the circumferential direction of the peripheral wall 78A (the pressure belt 66 rotation direction). Plural second ribs 78E are disposed at intervals along the length direction of the peripheral wall 78A.

An impregnated member 92 impregnated with a lubricating oil, serving as an example of a lubrication agent, is disposed on the outer peripheral face 78C of the peripheral wall 78A between the first ribs 78D and the second ribs 78E. The impregnated member 92 is, for example, configured from sponge or felt. The impregnated member 92 has its length direction running along the pressure belt 66 rotation axis direction, and is formed in a substantially rectangular shape.

Third ribs 78J are formed at the length direction outside of the impregnated member 92 at both length direction ends of the peripheral wall 78A, respectively. The third ribs 78J are formed along the circumferential direction of the peripheral wall 78A (the pressure belt 66 rotation direction). Configuration is made such that there is sliding contact of the inner peripheral face of the pressure belt 66 against the third ribs 78J, the second ribs 78E, the first ribs 78D and the impregnated member 92.

Side walls 78H are provided at both length direction ends of the peripheral wall 78A. Cutouts 78I are cut out in the heating roll 64 side of the respective side walls 78H. In a state in which the pressing member 80 is housed in the housing space 78B of the contact member 78, the projecting portions 84A of the plate body 84 are configured to project out to the outside from the cutouts 78I of the side walls 78H. At the outside face of each of the side walls 78H, a projection 78F and a projection 78G are formed projecting out to the outside in the length direction of the contact member 78. The projection 78F extends, in side view, along the plate portion 84B and projecting portions 84A of the plate body 84. The projection 78G is formed along the outer peripheral face 78C of the peripheral wall 78A.

Restricting members 88 are provided at the side wall 78H sides of the contact members 78, for restricting movement of the pressure belt 66 along the rotation axis direction thereof. The face at the side walls 78H side of each of the restricting members 88 is formed with a recess 88F and a recess 88G, into which the projection 78F and the projection 78G of the side walls 78H are inserted. An insertion hole 88A is formed in each of the side walls 78H, for insertion into by the respective projecting portion 84A of the plate body 84. The restricting members 88 are mounted to the contact member 78 by the projection 78F and the projection 78G of the side walls 78H being inserted into the recess 88F and the recess 88G, and by the projecting portions 84A of the plate body 84 being inserted into the insertion holes 88A.

When in a mounted state to the contact member 78, the restricting members 88 are position at the side edges of the pressure belt 66, and also jut out further to the radial direction outside than the outer peripheral surface of the contact member 78. Accordingly, when the pressure belt 66 moves in its rotation axis direction, the restricting members 88 make contact with the side edges of the pressure belt 66, and restrict further movement of the pressure belt 66 in the axial direction.

When in a mounted state to the contact member 78, the restricting members 88 are disposed at the inner peripheral side of the pressure belt 66, and contact faces 88H are formed to the restricting members 88 that make sliding contact with the inner peripheral face of the rotating pressure belt 66. These contact faces 88H are formed around the entire circumference of the pressure belt 66, and the axial direction end portions of the pressure belt 66 are supported by the contact faces 88H.

In the present exemplary embodiment, in a state in which the pressing member 80 is housed in the housing space 78B of the contact member 78, the contact member 78 is inserted through the internal space of the pressure belt 66. The projecting portions 84A of the plate body 84 of the pressing member 80, which has been inserted through the internal space of the pressure belt 66, are inserted into the insertion holes 88A of the restricting members 88, and the projection 78F and the projection 78G of the side walls 78H of the contact member 78 are also inserted into the recesses 88F and the recesses 88G of the restricting members 88. The pressure belt 66 is supported by the belt support member 76 by the projecting portions 84A of the plate body 84 being inserted into the insertion grooves 76B of the pair of side plates 76A of the belt support member 76. Furthermore, load is imparted at both pressure belt 66 rotation axis direction ends of the pressing member 80, due to the pair of side plates 76A of the belt support member 76 and the pair of side plates 74A of the roll support member 74 being pulled by tension of the tension springs 90, and the pressing member 80 presses the pressure belt 66 towards the heating roll 64.

Due thereto, the pressure belt 66 is rotatably supported on the fixing device body 62 by the belt support member 76 at a position facing the heating roll 64. Configuration of the heating roll 64 and the pressure belt 66 is made such that the heating roll 64 is rotationally driven, and the pressure belt 66 undertakes rotation following the rotation of the heating roll 64, with the recording medium P, onto which the toner image has been transferred, being nipped between the heating roll 64 and the pressure belt 66 and conveyed.

As shown in FIG. 2, the heating roll 64 is disposed lower than the pressure belt 66. Specifically, the heating roll 64 is disposed diagonally lower (at the left hand bottom side in FIG. 2).

Figure 8:
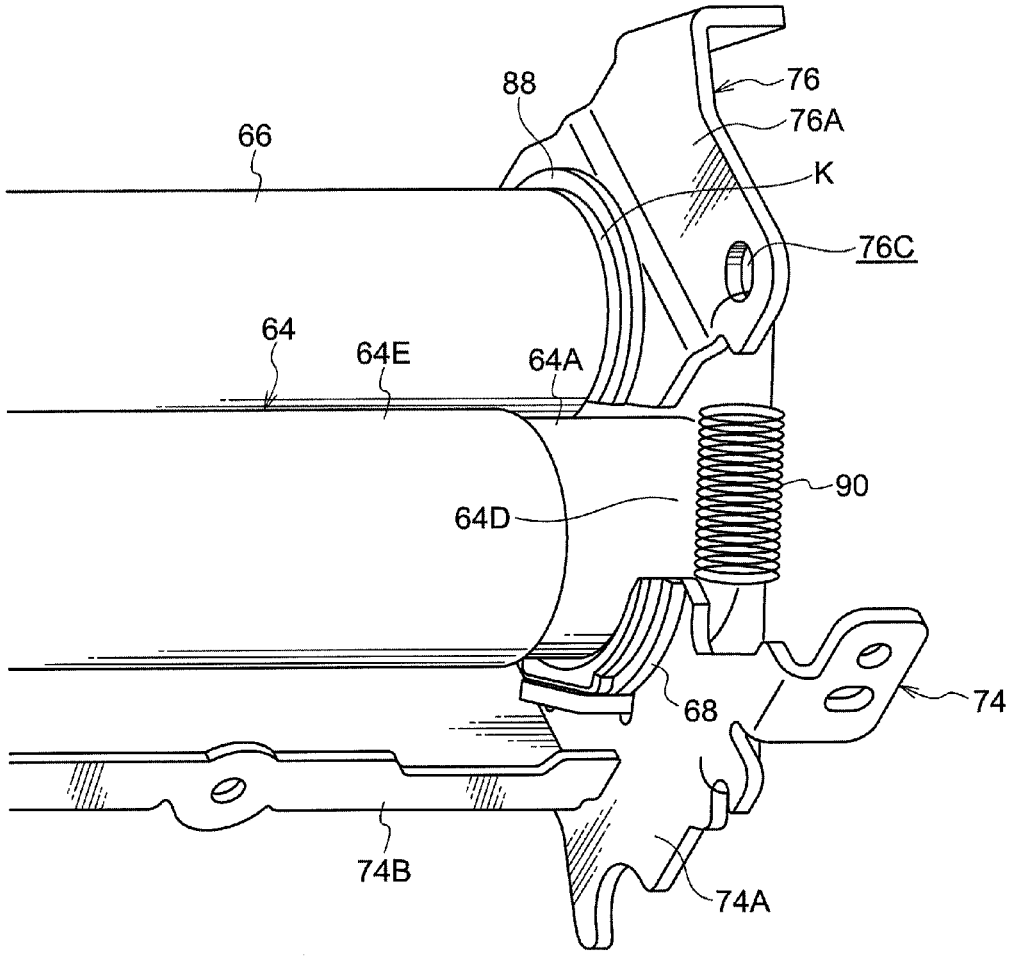
FIG. 8 is an enlarged perspective view showing a rotation axis direction end of the pressure belt at one side of the configuration shown in FIG. 4.

As shown in FIG. 8, in the present exemplary embodiment as described above, there is a gap K formed between the restricting members 88 and the edges of the pressure belt 66. The lubrication oil impregnated into the impregnated member 92 is thereby capable of exuding along the inner peripheral face of the pressure belt 66 to the outside of the pressure belt 66 from the side edges of the pressure belt 66.

Figure 9:
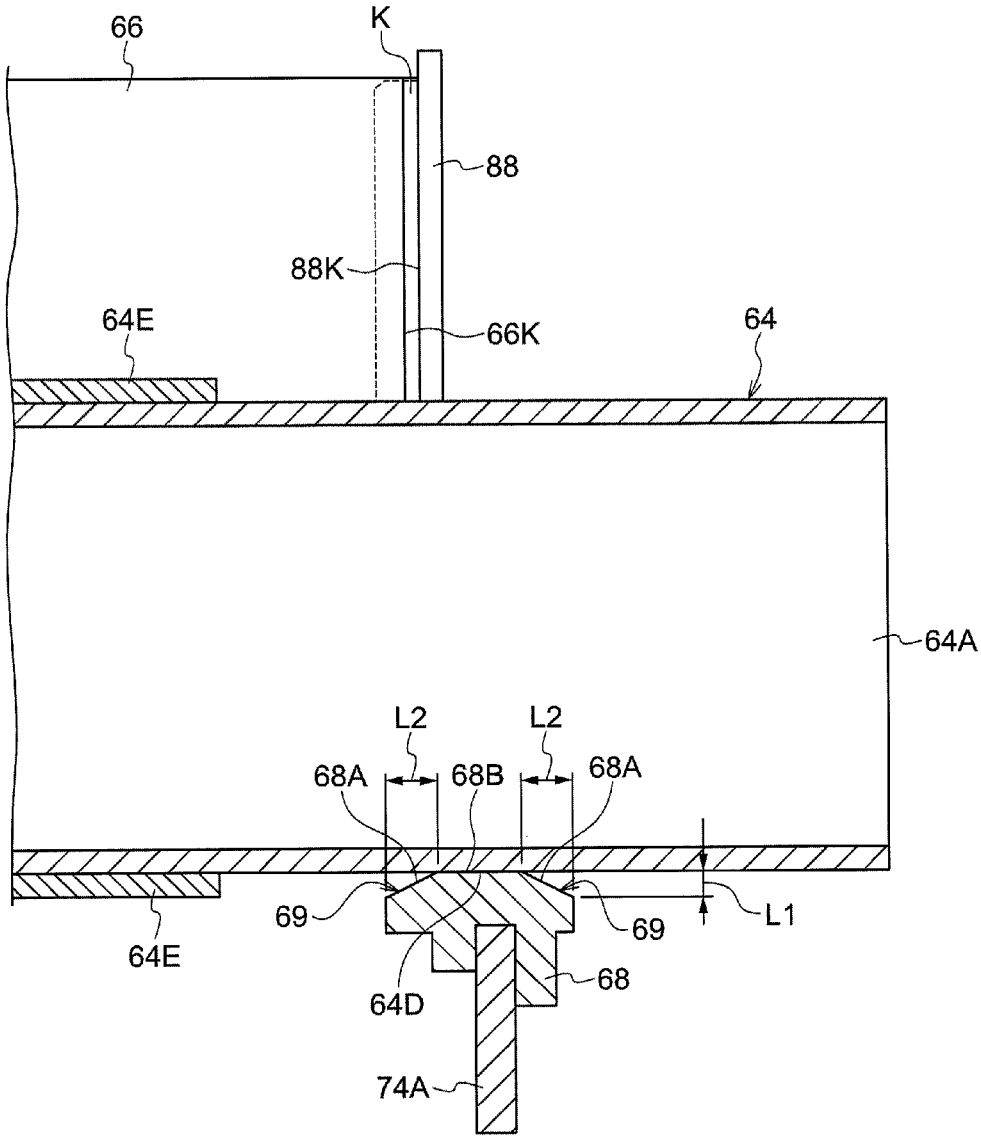
FIG. 9 is a partial cross-section of a pressure belt, heating roll and slide bearing according to the present exemplary embodiment.

The pair of slide bearings 68 formed in circular arc shapes are each respectively open to the pressure belt 66 side. The pair of respective restricting members 88 is disposed so as to overlap in the heating roll 64 rotation axis direction with the pair of slide bearings 68 and the pair of supported portions 64D, when viewed along the radial direction of the heating roll 64 (see FIG. 9). In FIG. 9, the restricting member 88 at one side of the pair of restricting members 88 is illustrated. Configuration may be made such that at least a portion of the restricting member 88 and at least a portion of the side bearing 68 and a portion of the supported portion 64D overlap.

Retaining portions 69 are provided to each of the slide bearings 68 for retaining lubrication oil. The retaining portions 69 are configured by gaps formed between the circular cylinder member 64A and the slide bearings 68, at one circular cylinder member 64A axial direction side of a support face 68B that supports the circular cylinder member 64A and the other side thereof. The retaining portions 69 are configured between inclined faces 68A, formed at one circular cylinder member 64A axial direction side of the support face 68B and the other side thereof, and the outer peripheral surface of the circular cylinder member 64A. The retaining portions 69 have a length L2 along the circular cylinder member 64A axial direction that is longer than a length L1 along the circular cylinder member 64A radial direction. As long as a gap is formed between the circular cylinder member 64A and the side bearing 68, the retaining portions 69 may be configured by, for example, a face parallel to the circular cylinder member 64A axial direction, instead of an inclined face.

Operation According to the Present Exemplary Embodiment

Next, explanation follows regarding operation according to the present exemplary embodiment.

In the present exemplary embodiment, the recording medium P, onto which a toner image has been transferred from the intermediate transfer belt 24 at the secondary transfer position, is fed in between the heating roll 64 and the pressure belt 66. The recording medium P that has been fed in between the heating roll 64 and the pressure belt 66 has heat imparted to the toner on the recording medium P by the heating roll 64, and has pressure imparted to the toner on the recording medium P by the pressure belt 66, while being conveyed nipped between the heating roll 64 and the pressure belt 66, and the image is thereby fixed onto the recording medium P.

In the present exemplary embodiment, the inner peripheral face of the rotating pressure belt 66 and the impregnated member 92 are in sliding contact, and lubrication oil impregnated into the impregnated member 92 is supplied to the inner peripheral face of the pressure belt 66. Due thereto, friction is reduced between the inner peripheral face of the pressure belt 66 and components in sliding contact with the pressure belt 66, these being the contact member 78 and the membrane body 86 of the pressing member 80.

A portion of the lubrication oil supplied to the inner peripheral face of the pressure belt 66 moves along the inner peripheral face of the pressure belt 66 in the rotation axis directions of the pressure belt 66, and leaks out to the outside of the pressure belt 66 from the side edges of the pressure belt 66.

The lubrication oil that has leaked out outside of the pressure belt 66 moves, due to, for example, its own weight, rotational force (centrifugal force) of the pressure belt 66 and the like, along the restricting members 88 and the side edges of the pressure belt 66, to the supported portions 64D that overlap with the restricting members 88 in the axial direction. Accordingly, lubrication oil is supplied between the supported portions 64D of the circular cylinder member 64A and the slide bearings 68. Consequently, frictional resistance is reduced between the circular cylinder member 64A of the heating roll 64 and the slide bearings 68.

In consideration of the lubrication oil, in particular movement of the lubrication oil along contact faces 88K of the restricting members 88 contacting the side edges of the pressure belt 66, and along the edges of the pressure belt 66, preferably at least one of the contact faces 88K of the restricting members 88, the edges 66K of the pressure belt 66 or the gap K is disposed so as to overlap in the heating roll 64 rotation axis direction with the slide bearings 68, as viewed along the heating roll 64 radial direction.

In the present exemplary embodiment, the lubrication oil supplied between the supported portions 64D and the slide bearings 68 is retained in the retaining portions 69, and so a supplied state of lubrication oil is better maintained between the circular cylinder member 64A and the slide bearings 68, compared to configuration without the retaining portions 69.

In the gap of the retaining portions 69, due to the length L2 along the circular cylinder member 64A axial direction being longer than the length L1 along the circular cylinder member 64A radial direction, the retaining force for retaining the lubrication oil is higher in comparison to configuration with the length L2 in the axial direction shorter than the length L1 in the radial direction.

In the present exemplary embodiment, for the lubrication oil that has moved to the circular cylinder member 64A, movement of the lubrication oil towards the circular cylinder member 64A axial direction center is restrained by the cover member 64E jutting out to the radial direction outside from the circular cylinder member 64A. Consequently, by thus restraining movement of the lubrication oil, the cover member 64E functions as a guide member, guiding the lubrication oil to the slide bearings 68 (to the supported portions 64D).

Figure 10:
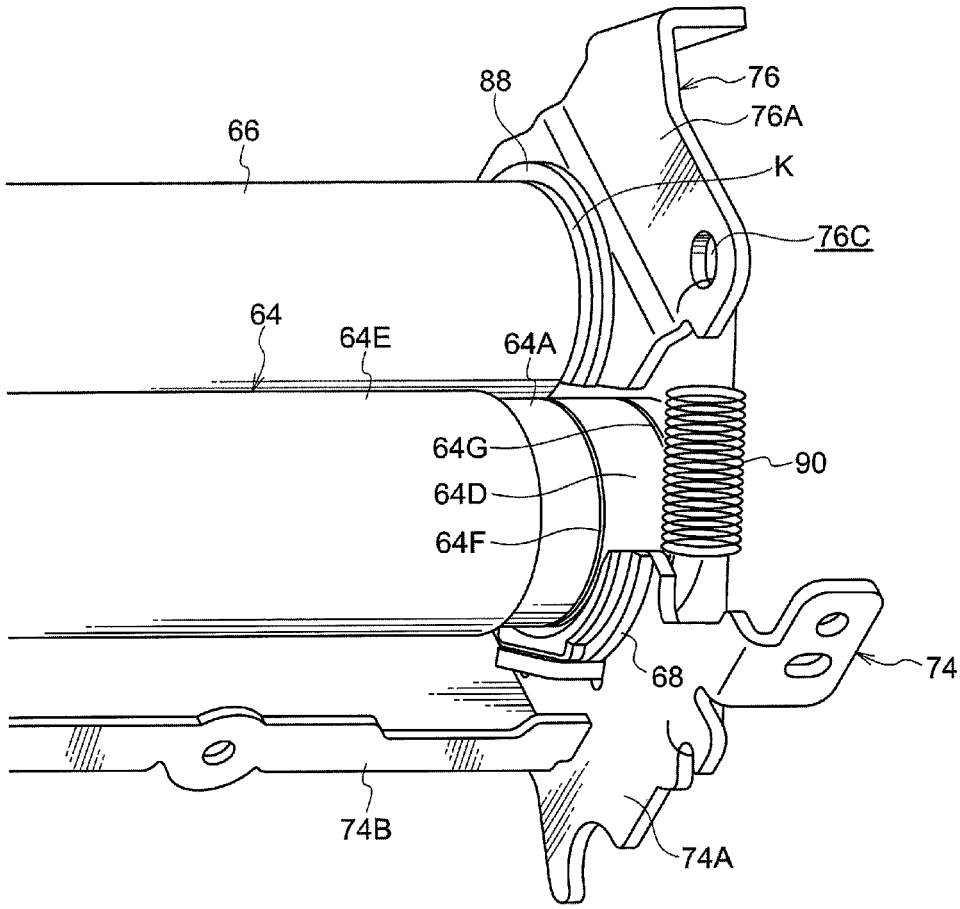
FIG. 10 is a perspective view showing a modified example of the configuration shown in FIG. 8, formed with a restraining groove.

As guide members that guide lubrication oil to the slide bearings 68, as shown in FIG. 10, configuration may be made with restraining grooves 64F formed along the circumferential direction of the circular cylinder member 64A between the cover member 64E and the supported portions 64D.

In such a configuration, the lubrication oil is restrained from moving towards the circular cylinder member 64A axial direction center by entering into the restraining grooves 64F. Accordingly, by thus restraining movement of the lubrication oil, the lubrication oil is guided to the slide bearings 68 (to the supported portions 64D). Configuration may be made with protruding portions that protrude out from the circular cylinder member 64A in the radial direction, formed along the circumferential direction of the circular cylinder member 64A, in place of the restraining grooves 64F.

As guide members that guide lubrication oil to the slide bearings 68, as shown in FIG. 10, configuration may be made with restraining grooves 64G formed to the supported portions 64D along the circumferential direction of the circular cylinder member 64A at the circular cylinder member 64A axial direction outside (at the right hand side in FIG. 10).

In such a configuration, movement of the lubrication oil to the circular cylinder member 64A axial direction outside (the right hand side in FIG. 10) is restrained by the lubrication oil entering within the grooves of the restraining grooves 64G. Accordingly, by thus restraining movement of the lubrication oil, the lubrication oil is guided to the slide bearings 68 (to the supported portions 64D). Projecting portions that project out in the radial direction from the circular cylinder member 64A may be formed along the circumferential direction of the circular cylinder member 64A in place of the restraining grooves 64G.

As guide members that guide lubrication oil to the slide bearings 68, configuration may be made with, for example, guide grooves formed facing the slide bearings 68 (the supported portions 64D), so as to guide the lubrication oil towards the slide bearings 68 (the supported portions 64D) by capillary action. As examples of such guide grooves, for example, there are grooves formed along the circular cylinder member 64A axial direction. Configuration may also be made with guide grooves formed facing the slide bearings 68 (the supported portions 64D), for example, guiding lubrication oil to the slide bearings 68 (the supported portions 64D) by rotation force of the heating roll 64. An example of such guide grooves is, for example, grooves formed in a helical shape.

Figure 11:
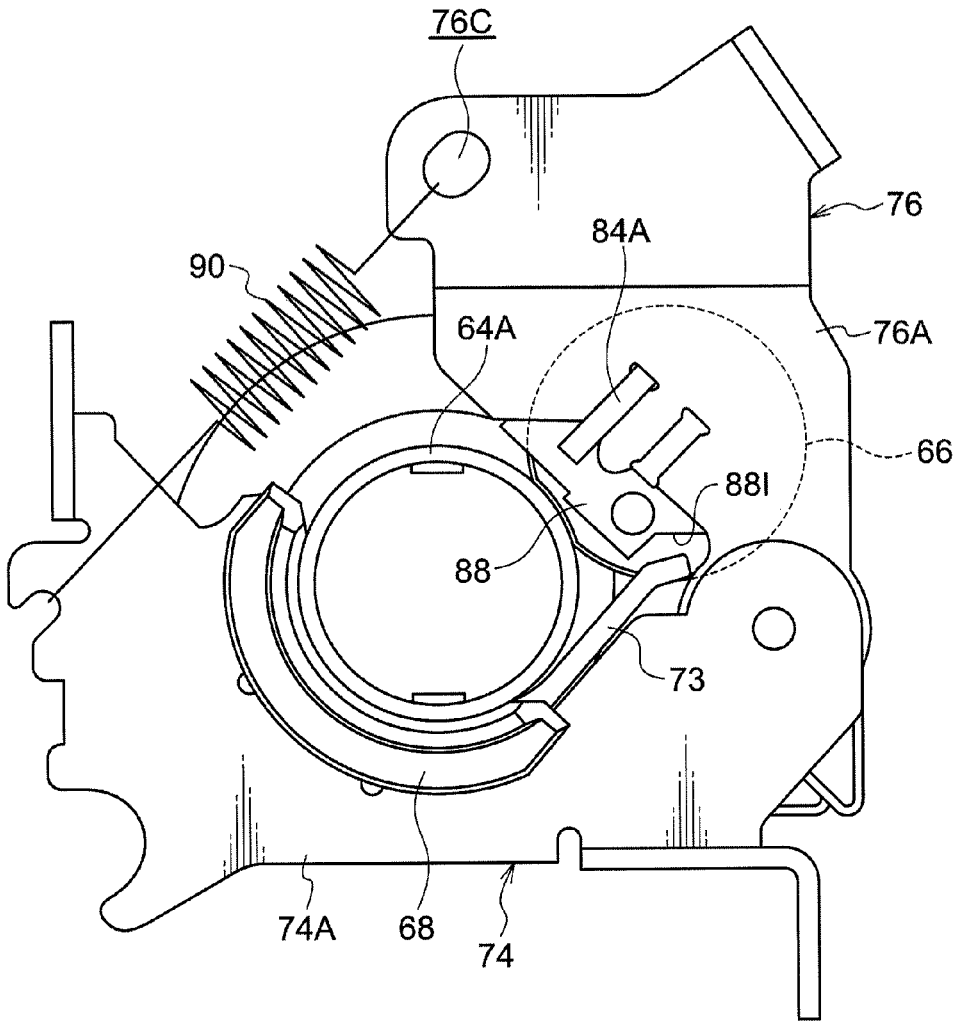
FIG. 11 is a side view of the configuration shown in FIG. 4.

As guide members that guide lubrication oil to the slide bearings 68, as shown in FIG. 11, configuration may be made with guide members 73 extending from the pressure belt 66 to the slide bearings 68 (the supported portions 64D).

Such guide members 73 are, for example, formed such that one end portion thereof passes through a cutout 88I, formed by cutting away a portion of the restricting members 88, so as to be disposed at the inner peripheral side of the pressure belt 66 when viewed from the side, and with the other end portion of the guide members 73 disposed at the slide bearings 68. The one end portion of the guide members 73 is disposed at the lower side of the pressure belt 66, so as to guide lubrication oil accumulated in the lower portion at the inner peripheral side of the pressure belt 66. This one end portion of the guide members 73 is, for example, in contact with the side edge, or one or the other of the inner peripheral face or the outer peripheral face of the pressure belt 66. The end portion of the guide members 73 may be configured inserted at the inner periphery of the pressure belt 66, from the side edge of the pressure belt 66 along the pressure belt 66 rotation axis direction, so as to make contact with the impregnated member 92 or the contact member 78. Configuration may also be made with the end of the contact member 78 not in contact with the pressure belt 66, but in contact with the restricting members 88.

Due thereto, the lubrication oil of the impregnated member 92 is supplied directly to the slide bearings 68 through the guide members 73, and not via the restricting members 88 or the like.

Figure 12:
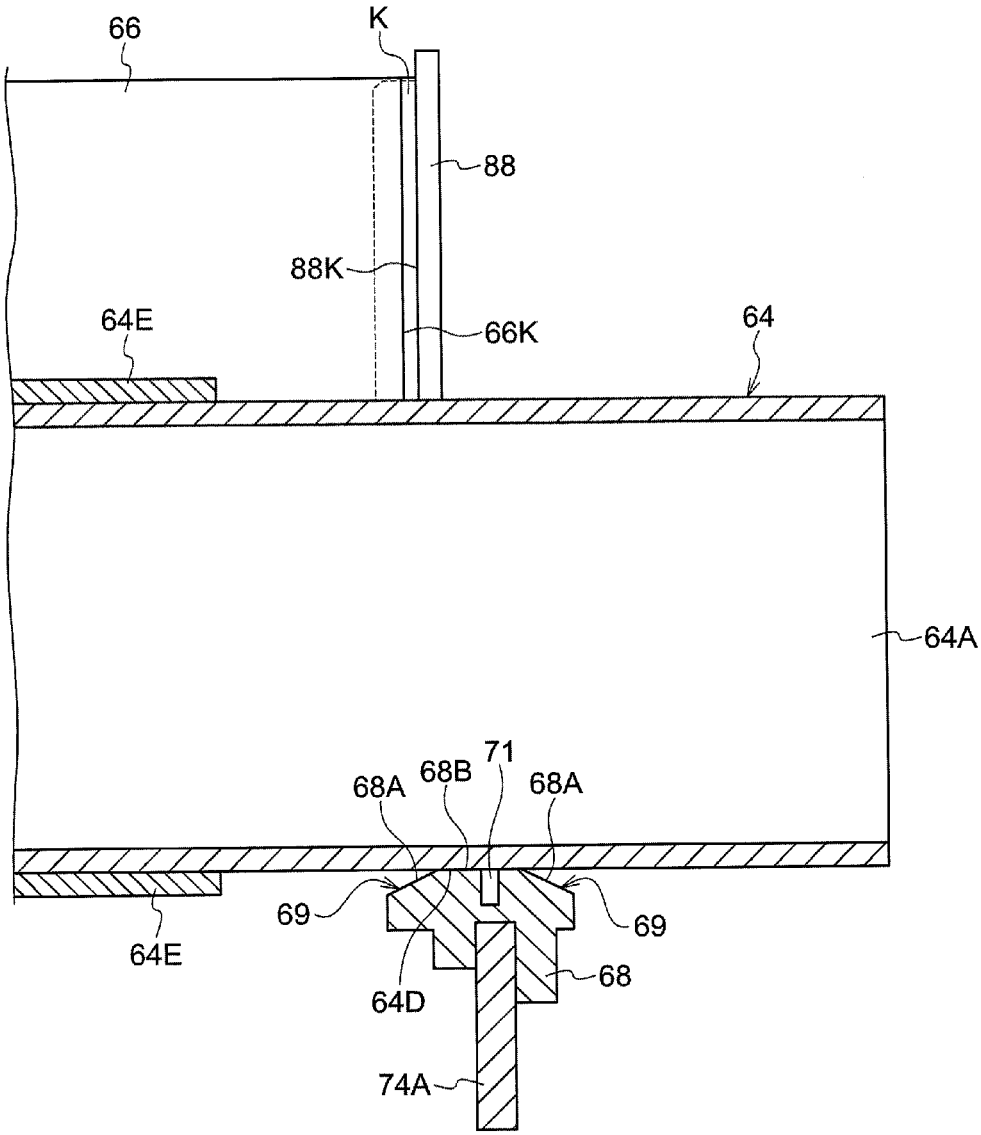
FIG. 12 is a diagram showing a modified example of the retaining portion from the configuration shown in FIG. 9.

As shown in FIG. 12, as a retaining portion for retaining the lubrication oil, configuration may be made with a retaining groove 71 for retaining the lubrication oil formed at the support face 68B at a circular cylinder member 64A axial direction central portion thereof. The retaining groove 71 is formed along the circumferential direction of the circular cylinder member 64A. Configuration may be made with this retaining groove formed at the supported portions 64D side.

As the retaining portions 69 for retaining lubrication oil, configuration may be made with an impregnatable member capable of being impregnated with lubrication oil. Sponge or felt is, for example, employed for such an impregnatable member. In place of lubrication oil, grease having a certain amount of flowability may be employed. A grease that undergoes a certain amount of liquefaction due to heat of the heating roll 64 and is capable of moving to the slide bearings 68 is more preferable. By employing a grease, not only can the impregnatable member be omitted as appropriate, but also, when the image forming apparatus is not being used, such as, for example, during transportation, lubrication oil can be prevented from leaking out from the side edges of the pressure belt 66 and adhering to unintended locations.

In the present exemplary embodiment, configuration may be made with an extrusion mechanism that extrudes the lubrication oil impregnated into the impregnated member 92 onto the edges of the pressure belt 66. Such an extrusion mechanism is, for example, configured such that the contact pressure of the impregnated member 92 to the inner peripheral face of the pressure belt 66 either decreases gradually or stepwise on progression from the length direction central portion of the impregnated member 92 towards the two length direction end portions thereof. As such a configuration where the contact pressure decreases gradually, or stepwise, for example the overall external diameter of the contact member 78, the pressing body 82 and the impregnated member 92 may be made to decrease gradually, or stepwise, from a length direction central portion of the impregnated member 92 towards the two length direction ends thereof.

According to such a configuration, due to pressure of the length direction central portion of the impregnated member 92 pressing the inner peripheral face of the pressure belt 66, lubrication oil at the length direction central portion of the impregnated member 92 is moved towards the two length direction ends where the contact pressure is weaker.

The present invention is not limited to the above exemplary embodiments, and various variations, modifications and improvements are possible. For example, configuration may be made with a heat source disposed inside the pressure belt 66, and the pressure belt 66 employed as a heating belt. In such a configuration, the heating roll 64 may be employed as a press roll. In a configuration in which the pressure belt 66 is employed as a heating belt, the placement positions of the pressure belt 66 and the heating roll 64 may be swapped over.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A conveying device comprising:

a rotating body that rotates;

a belt that contacts the rotating body and rotates;

a restricting member that is disposed at each of the two rotation axis direction side edges of the belt, positions the side edges of the belt, and restricts movement of the belt in the rotation axis direction;

a lubrication agent that is supplied to the inner peripheral face of the belt; and a slide bearing that is disposed so as to overlap in the rotation axis direction with the restricting member when viewed along a rotating body radial direction, the slide bearing being open to the belt side and rotatably supporting the rotating body.

2. The conveying device of claim 1, further comprising a guide member that guides the lubrication agent to the slide bearing.

3. The conveying device of claim 2, wherein the guide member comprises a covering member that covers the rotating body.

4. The conveying device of claim 2, wherein the guide member comprises a groove that is formed along the circumferential direction of the rotating body.

5. The conveying device of claim 2, wherein the guide member comprises a protruding portion that is formed along the circumferential direction of the rotating body and protrudes outwards in a radial direction at a peripheral surface of the rotating body.

6. The conveying device of claim 2, wherein the guide member is configured such that one end of the guide member contacts the belt and the other end of the guide member reaches to the slide bearing.

7. The conveying device of claim 1, further comprising a retaining portion that is provided at the slide bearing and retains the lubrication agent.

8. The conveying device of claim 7, wherein the retaining portion includes a gap formed between the rotating body and a support face of the slide bearing supporting the rotating body at a rotating body axial direction end portion of the support face, and the rotating body axial direction end portion of the support face has a face inclined with respect to the rotational body axial direction.

9. The conveying device of claim 7, wherein the retaining portion comprises a groove formed along a circumferential direction on a support face of the slide bearing supporting the rotating body.

10. The conveying device of claim 7, wherein the retaining portion is configured by a material having impregnation characteristics.

11. The conveying device of claim 1, further comprising an extrusion mechanism that extrudes the lubrication agent out towards a side edge of the belt.

12. A fixing device comprising the conveying device of claim 1, wherein at least one of the rotating body or the belt comprises a heating source, and an image is fixed to a recording medium at a contact region of the rotating body and the belt.

13. The fixing device of claim 12, wherein the lubrication agent is a grease that liquefies due to the heating source.

14. An image forming apparatus comprising:

an image forming section that forms an image on a recording medium; and the fixing device of claim 12 that fixes the image formed by the image forming section onto the recording medium.

* * * * *